US005129631A

United States Patent [19]

Van Laar

[11] Patent Number: 5,129,631

[45] Date of Patent: Jul. 14, 1992

[54] HANDLING MOLTEN MATERIALS

[75] Inventor: Jacobus Van Laar, Driehuis, Netherlands

[73] Assignee: Hoogovens Groep BV, IJmuiden, Netherlands

[21] Appl. No.: 686,298

[22] Filed: Apr. 16, 1991

Related U.S. Application Data

[63] Continuation of Ser. No. 447,053, Dec. 7, 1989, abandoned.

[30] Foreign Application Priority Data

Dec. 19, 1988 [NL] Netherlands ..... 8803103

[51] Int. Cl.[5] ..... C21B 7/14

[52] U.S. Cl. ..... 266/196; 266/280; 266/285

[58] Field of Search ..... 266/280, 285, 286, 196

[56] References Cited

U.S. PATENT DOCUMENTS 4,508,323 4/1985 Fleming ..... 266/196
4,531,717 7/1985 Hebrant ..... 266/231
4,573,668 3/1986 LaBate ..... 266/196

FOREIGN PATENT DOCUMENTS 0379172 4/1985 Austria .
0060239 9/1982 European Pat. Off. .
2433723 3/1980 France .
0773272 4/1957 United Kingdom .

*Primary Examiner*—Scott Kastler
*Attorney, Agent, or Firm*—Stevens, Davis, Miller & Mosher

[57] ABSTRACT

To diminish cracking due to differential expansion of refractory channels conducting molten materials, e.g. in an iron runner or iron trough, lateral pressure is exerted inwardly on the wear lining of such a channel through intermediate layers of permanent lining. These may include low friction slide plates and at least one layer having a high thermal conductivity. The means exerting the pressure react against an external frame structure and are preferably such that the pressure exerted is independent of the degree of expansion of the channel.

12 Claims, 1 Drawing Sheet

HANDLING MOLTEN MATERIALS

This application is a continuation of U.S. patent application Ser. No. 07/447,053, filed Dec. 7, 1989.

FIELD OF THE INVENTION

This invention relates to apparatus and methods for handling molten materials. Particular examples of such materials are the iron and slag tapped from a blast furnace, and the invention will be specifically described with reference to channels used for the reception of iron from the furnace and known as iron troughs and iron runners, though it is not limited thereto.

BACKGROUND OF THE INVENTION

An iron runner having a wear lining which during operation actually contacts the iron and a permanent lining in which the wear lining is contained is known, and may be air-cooled either by forced or ambient air or be water-cooled or cooled in other ways, for example with a glycol/water mixture.

The wear lining of an iron runner may consist of a refractory concrete, and the permanent lining may be carbon in combination with aluminium oxide bricks, or just aluminium oxide bricks. It is usual for the outside of the iron runner to be formed by a steel outer casing, sometimes known as a box. For strength considerations this steel may not receive any temperatures higher than approx. 260° C. The crude iron comes out of the blast furnace directly into contact with the wear lining and has a temperature of approx. 1500° C.-1550° C. As a result substantial thermal stresses occur in the structure of the iron runner, expanding it considerably.

A typical iron runner may be twenty meters long and three meters wide. Through contact with the crude iron the wear lining of a refractory concrete expands longitudinally about 18 centimeters and in width about 2.7 centimeters.

However, the permanent lining, outside the wear lining, is subjected to a lower temperature and moreover is made of another material so that it expands much less. As a consequence of the stresses in the wear lining and the permanent lining resulting from these differences, these linings tend to crack, especially near the bottom of the runner. Also, given that the iron runner is anchored at the furnace end to prevent it from moving there, and the bottom of the runner does expand horizontally, this cracking occurs mainly in the side walls of the linings.

The first mentioned cracking arising from temperature difference occurs even if the linings are provided with expansion joints for taking up the expansion caused by going from the cold condition to the operational condition. This is because these linings do not experience uniform expansion.

Cracking also leads to the problem that, when the iron runner is taken out of service for maintenance, iron solidifies in the cracks. Once the iron runner is put into operation again, further expansion then takes place so that the dimensions of the iron runner increase still further. Significant distortions then occur whereby the iron runner structure undergoes further damage. During operation the cracking leads to the risk of the molten material breaking-through, necessitating costly repair work to the entire iron runner structure.

The invention relates to a method and structure for handling molten material wherein the linings are subjected to substantial compression both before and during their operation.

In the prior art, GB-A-773272 shows compression springs acting from side walls of a steel casing on an end plate of the casing of a transfer trough so as to compensate for the thermal expansion of that casing in the longitudinal direction being greater than that of the refractory mass. The end plate is movable relative to the side walls of the casing.

"Iron and Steel Engineer" October 1988 pages 35-37 and 47-51 shows various methods of cooling troughs or runners and discusses various conformations of working and permanent linings, some of which are made of individual bricks. On page 48 FIG. 2 shows a structure, said to be patented, which includes lining layers of high thermal conductivity.

AT-B-379172 shows a slag runner of which an inner boundary between coolant medium and the slag is laterally flexed by a hydraulic or pneumatic cylinder and piston arrangement.

SUMMARY OF THE INVENTION

According to the invention, apparatus including a channel for handling molten material defined by a wear lining and having an outer metal casing upon which pressure means act is characterised by the pressure means acting on at least side walls of the casing from a reaction point, whereby to exert pressure through said casing side walls and an intervening permanent lining on the wear lining.

The effect of this is to counteract cracking and where cracks do occur they are sealed off so that molten material cannot solidify in there, so that damage to the apparatus is prevented. A simple embodiment is that whereby sets of springs are used for pressing against the casing walls. As expansion increases the compression load also increases. However, it is preferable for the compression load to be almost independent of the variation in size of the casing. For the pressure means hydraulic or pneumatic means which may be more easily adjusted than sets of springs are preferable. Loading independent of expansion means that independently from the actual sizes of the apparatus, sufficient crack sealing loading is always exerted before, during and after the presence of molten material in the apparatus. It is desirable that the underside of the casing is constructed in such a way that it is free to move relative to the side walls. Likewise it is desirable that side walls of at least the outer ones of the various lining layers, which are generally of U-shape in lateral cross section, shall have side walls separate from and able to move at least laterally relative to the bottom wall of the U.

It is also advisable for the end wall of the casing to consist of at least two parts vertically above one another and which can move relative to each other. In this way account is taken of variations in expansion in the apparatus.

Furthermore, it is desirable that the pressure means provide for a distribution of the compression load so that it is dependent on the position of each pressure point onto the wall of the casing, in such a way that the compression load decreases generally from the bottom of the casing towards the top. In this way account is taken of the variations in expansion forces connected with the temperature gradient in the structure. When sets of springs are used as pressure means this is simple to achieve by combinations of sets of springs with different spring constants depending on the position of action against the wall of the casing.

It is an advantage to fit at least one slide plate, for example of graphite, between wear lining and permanent lining. The weight of the wear lining with the molten material inside it is so high that this provision helps to counteract cracking which is caused when relative movement is prevented by friction. This favourable effect is obtained in particular if two adjoining slide plates are fitted between wear lining and permanent lining, both of them preferably being made of graphite.

It is preferable to make the apparatus in such a way that at least the wear lining is made up of at least two layers able to move relative to one another. The thermal stresses in each wear layer are less than in a wear lining in a single piece because the temperature gradient over the wear lining is distributed over a number of smaller temperature gradients.

Preferably at least one slide plate also acts as an intermediate lining and has a coefficient of heat conductivity higher than approx. 25 kcal/m°C.h. Suitable examples for this are semi-graphite or graphite. This enables an adequate temperature equalisation on the cooler side of the wear lining, so that this wear lining experiences less thermal stresses and less cracking, and as a result lasts longer. Moreover, when designing the apparatus, less attention then needs to be paid to conducting out heat from local hot spots.

As is known from "Iron and Steel Engineer" October 1988, page 48, FIG. 2, the apparatus may have an outer lining, comprising two more outer layers, outside the permanent lining of which one has a higher coefficient of heat conductivity than the second. This one outer lining layer, which is made for example of semi-graphite or graphite, but which may alternatively be of copper, is in that case the one located on the outmost side, next to the casing.

Because of the high conductivity of this layer and its position next to the casing it is used as final protection against break-through of material that has penetrated through cracks into the wear lining and permanent lining as far as this outer lining.

However, the chance of a break-through of material which has seeped through is made even less if the first outer lining is not fitted on the outermost side but rather, as is proposed in an embodiment of the present invention, right next to the permanent lining and has a coefficient of heat conductivity higher than approx. 25 kcal/m°C.h. This makes the heat from the material at the position of a crack spread over a larger cooling surface and the safety of the system is greatly increased. It is also desirable that this outer lining layer which is fitted to the end wall of the apparatus is extended through to the side walls of the casing. This enables local peaks in thermal loading of the permanent lining at the end wall of the apparatus to be equalised quickly, which extends the useful life of the permanent lining.

It has also been found to be an advantage that the side of the wear lining adjacent the permanent lining may have an upwardly narrowing dovetail section. This counteracts vertical displacement of the wear lining by expansion.

In a specific embodiment, setting of the pressure means is selected in such a way that they exert a compression load which lies at a given point in the range 60–80% of the ultimate compressive stress value of the wear lining at operating temperature at the level of that point. "Ultimate compressive stress" is taken to mean the compression load just at the point when the wear lining breaks.

In accordance with this embodiment not only are the cracks kept sealed under pressure, but cracking is also counteracted by a sufficiently high compression load being applied that the thermal tensile stresses in the wear linings are at least compensated.

In a further aspect of the invention, a method of handling molten material in a wear lining channel of refractory material comprises applying compressive force onto the wear lining through a permanent lining, by pressure on at least side walls of a casing containing the linings. The pressure so applied is preferably, at a given point, in the range of pb 60 to 80% of the ultimate compressive stress of the wear lining at the level of that point.

BRIEF DESCRIPTION OF THE DRAWINGS

The presently preferred embodiment of the invention will now be illustrated by reference to the drawings.

DETAILED DESCRIPTION OF THE INVENTION

Figure 1:
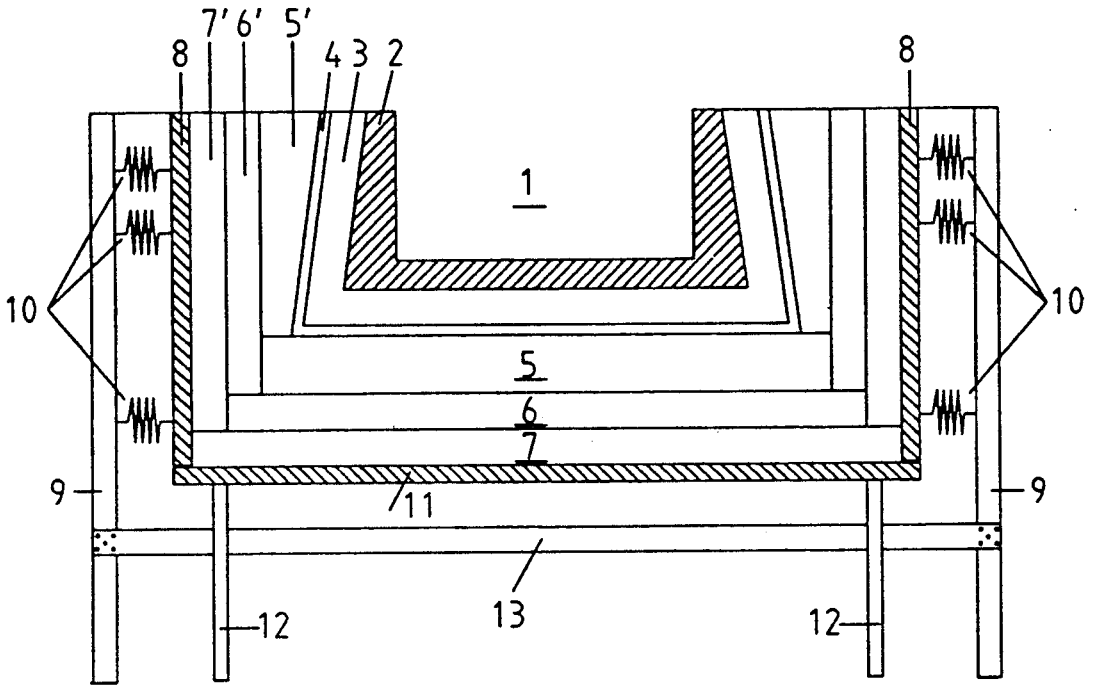
FIG. 1 shows a cross-section of an iron runner embodying the invention.

In FIG. 1 an iron runner 1 is shown of which the boundary surface defining the channel for carrying the iron is formed by a wear lining 2. The wear lining 2 may consist of a number of layers able to move relative to each other. Different kinds of material may be used for it, but it is normal to use a refractory concrete.

Directly adjoining the wear lining 2 an intermediate lining 3 of graphite is used for fast temperature equalisation of hot spots in the wear lining 2. Between the intermediate lining 3 and permanent lining 5 there is a graphite slide plate 4. This facilitates the differential expansion of the wear lining 2 and permanent lining 5.

This is achieved especially because the slide plate 4 adjoins an intermediate lining 3 which is likewise of graphite and acts as a second slide plate. It has a low friction coefficient (approx. 0.05–0.2). Moreover, the graphite intermediate lining 3 has the advantage of a high coefficient of heat conductivity of at least 60 kcal/m°C.h.

The outer boundary of the wear lining 2 and the inner one of the permanent lining 5 can be seen in cross-section to form an upwardly-narrowing dovetail section, so that the side walls of the intermediate lining 3 and slide plate 4 are somewhat inclined to the vertical. This helps counteract any tendency towards vertical displacement of the wear lining.

Beyond the permanent lining 5, which may be made for example of aluminium oxide or of carbon in combination with aluminium oxide, are successively a first outer lining layer 6 and a second outer lining layer 7. The first outer lining layer 6 is of graphite. This gives a good temperature equalisation so that seeping iron that has reached this outer lining through cracks in the wear lining 2 and permanent lining 5 has less chance of breaking through. The effect of this good temperature equalisation on the permanent lining 5 also works to the benefit of its service life.

The second outer lining layer 7 may be for example of carbon. Adjoining this is a steel casing of which the plates are free to move relative to each other at the side walls 8 and the bottom 11. The steel end wall of the casing at the end 14 of the runner consists of a number of parts 14' and 14'' vertically above one another and which are able to move relative to each other.

It can be seen from the drawing that the side walls 5', 6', 7' of the generally U-section lining layers 5, 6, 7 are separate from the floors of those sections.

Figure 2:
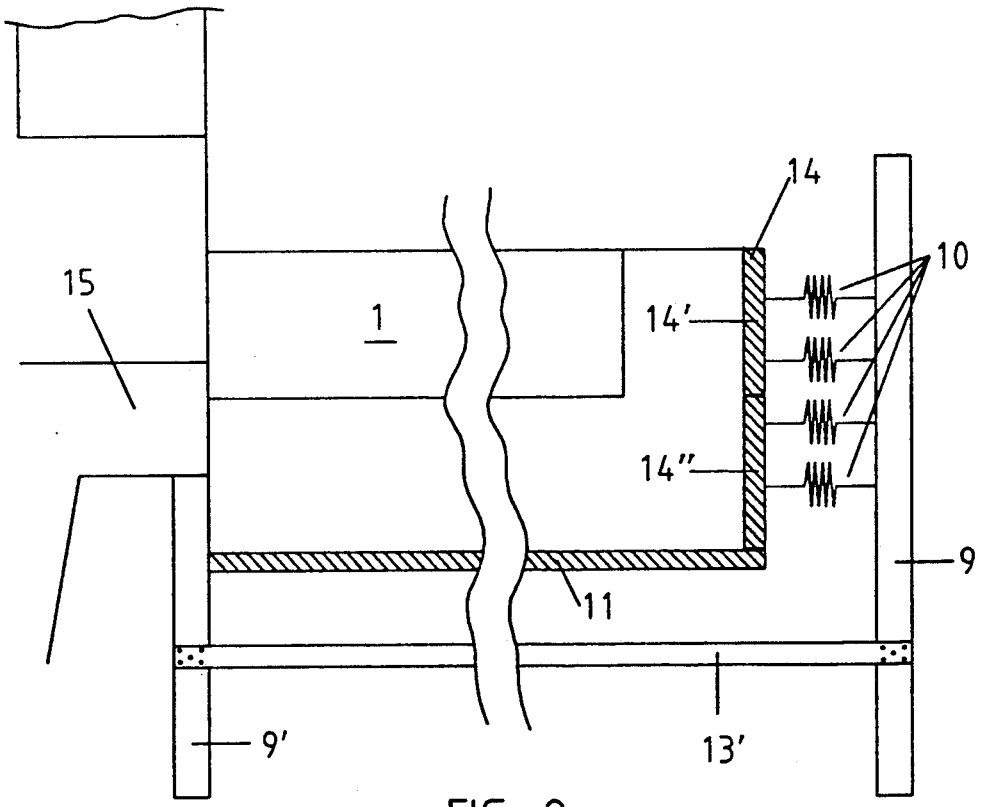
FIG. 2 shows a side view of the iron runner.

The side walls 8 and the end wall 14 (see FIG. 2) are supported by pressure means 10 mounted on heavy girders 9 which may also be anchored together by transverse girders 13 to form a frame. The girders provide a reaction point for exerting pressure both on the walls of the casing and through them on the linings.

The pressure means 10 may be sets of springs or hydraulic or pneumatic means. It is possible to adjust hydraulic pressure units in such a way that the pressure applied is independent of the expansion of the iron runner at any time. This has the advantage that sufficient loading is always present on the iron runner in order to seal under pressure any cracks which have formed.

For this it is important that the structure bearing the pressure means 10 which are placed in the longitudinal direction of the iron runner to act on its end wall be arranged in such a way that forces are not exerted on the blast furnace structure 15. A heavy girder section 9' may be provided at the blast furnace side so that the iron runner is prevented from moving in that direction. It may be advantageous also to use a heavy transverse girder section 13', possibly a tie rod between the ends of the runner.

It is desirable to take account of expansion variations in the iron runner by applying a greater compression load at the upper part of the structure on the side walls 8 and the end wall 14, than on the part lower down; for example, if the pressure means 10 are springs, extra sets of springs or a set of springs with higher spring constants are used. Furthermore the steel bottom 11 of the casing must be able to move freely relative to the side walls 8 and the end wall 14 of that casing.

In a specific embodiment the sets of springs or hydraulic or pneumatic means may exert a compression load which at a given pressure point lies in the range 60–80% of the ultimate compressive stress value of the wear lining at the operating temperature at the level of the given point.

In this way the tensile forces in the linings as a result of expansion variations are at least compensated, which means that the entire structure comes under a compression load exerted from the reaction structure 9, 13, 9', 13'. This prevents stress cracks in the various linings. Stresses in individual linings may further be counteracted by dividing those linings into two or more layers. For example the wear lining 2 may be made up of two wear layers which are able to move relative to each other.

Though specifically described with reference to an iron runner the invention is also applicable to iron troughs and slag troughs, and also to the handling of other molten materials, such as copper and aluminium.

I claim:

1. In a channel apparatus for handling molten iron wherein there is a wear lining having a lengthwise direction for contacting the molten iron, at least one lining layer outside said wear lining and a casing outside of and containing said at least one lining layer, said linings and casing being capable of expansion, said wear lining and outside lining having different degrees of thermal stress, said casing having side walls positioned on the outside of said wear lining and extending in the lengthwise direction of said wear lining and being susceptible of receiving temperatures up to 260° C., the improvement comprising a support frame pressure means and means operatively connecting said pressure means to said support frame and to said side walls of said casing, said pressure means maintaining pressure on said linings through said casing sidewalls at least equal to said pressure on said linings through said casing side walls prior to expansion of said linings and casing to counteract cracking of said linings.

2. The improvement as claimed in claim 1 wherein said channel and said casing additionally have an end wall, and pressure means on said support frame are provided for additionally exerting said pressure on said linings through said casing end wall.

3. The improvement as claimed in claim 2 wherein the said side walls of said casing are detached from a bottom wall thereof.

4. The improvement as claimed in claim 2 wherein said linings are of generally U-shape lateral cross-section and side walls of said U-shape sections of at least some of said lining layers are detached from a bottom wall of a respective said layer.

5. Channel apparatus for conducting molten iron comprising a wear lining capable of expansion having an inner surface defining a channel and an outer surface, a generally U-section permanent lining capable of expansion beyond said outer surface and having side walls and a bottom wall, a generally U-section casing capable of expansion beyond said permanent lining and having side walls extending lengthwise of said channel and a bottom wall;

side walls of said permanent lining lying between the side walls of said casing and said wear lining, a support frame, pressure means connected to said support frame for exerting laterally inward pressure on said side walls of said casing and therethrough on said linings to counteract cracking of said linings, said pressure means maintaining pressure on said lining and sidewalls of said casings at least equal to said pressure on said linings and sidewalls of said casing prior to expansion.

6. Channel apparatus according to claim 5 wherein said pressure means are selected from hydraulic and pneumatic pressure means adapted to provide substantially constant pressure independent of a degree extension of said means.

7. Channel apparatus according to claim 6 wherein said pressure means are arranged to exert at a given position a force of 60 to 80% of the ultimate compressive stress value of the wear lining, at working temperature, at the level of that point.

8. Channel apparatus according to claim 5 wherein said side walls are detached from said bottom walls.

9. Channel apparatus according to claim 5 wherein said outer surface of said wear lining narrows upwardly.

10. Channel apparatus for conducting molten iron comprising a central wear lining capable of expansion having an inner surface and an outer surface, said inner surface defining a lengthwise channel for conducting said molten material; and the following elements i–vi capable of expansion successively outwardly therefrom on each lateral side of and below the wear lining:

i) at least one slide plate ii) a lining layer of high thermal conductivity which may be the said slide plate or one of the said slide plates iii) a permanent lining iv) a first outer lining layer v) a second outer lining layer, a thermal coefficient of conductivity of the first outer lining layer being greater than the thermal coefficient of conductivity of the second outer lining layer vi) a metallic casing having side walls and an end wall;

vii) a support frame; and pressure means connected to said support frame acting laterally inwardly on side walls of the metallic casing extending lengthwise of said channel for applying compressive pressure laterally of said elements i–vi and maintaining pressure thereon at least equal to said pressure on said wear lining and elements i–vi prior to expansion.

11. Channel apparatus according to claim 10 wherein side walls of at least some of said elements i–vi are separate from the bottom walls of the respective said elements.

12. Channel apparatus according to claim 10 wherein said channel and said casing have additionally an end wall, and pressure means for acting longitudinally on said end wall of said casing to exert longitudinally inward pressure on it.

* * * * *